US009573665B2

(12) United States Patent
Ogden

(10) Patent No.: US 9,573,665 B2
(45) Date of Patent: Feb. 21, 2017

(54) DC MOTOR TOW WINCH

(71) Applicant: Everett Ogden, Ponte Vedra Beach, FL (US)

(72) Inventor: Everett Ogden, Ponte Vedra Beach, FL (US)

( * ) Notice: Subject to any disclaimer, the term of this patent is extended or adjusted under 35 U.S.C. 154(b) by 204 days.

(21) Appl. No.: 13/894,947

(22) Filed: May 15, 2013

(65) Prior Publication Data

US 2013/0305954 A1 Nov. 21, 2013

Related U.S. Application Data

(60) Provisional application No. 61/647,357, filed on May 15, 2012.

(51) Int. Cl.

| | |
|---|---|
| ***B66D 1/46*** | (2006.01) |
| ***B63B 35/81*** | (2006.01) |
| ***B61B 11/00*** | (2006.01) |
| ***B61C 17/12*** | (2006.01) |

(52) U.S. Cl.

CPC ..... *B63B 35/816* (2013.01); *B61B 11/00* (2013.01); *B61B 11/002* (2013.01); *B61C 17/12* (2013.01); *B63B 35/815* (2013.01); *B63B 35/817* (2013.01); *B66D 1/46* (2013.01)

(58) Field of Classification Search

CPC ..... B63B 35/815–35/817; B61B 11/002
USPC ..... 104/173.2
See application file for complete search history.

(56) References Cited

U.S. PATENT DOCUMENTS

| | | | | |
|---|---|---|---|---|
| 3,098,463 | A * | 7/1963 | Brown | 114/254 |
| 3,964,425 | A * | 6/1976 | Septor, Sr. | 242/390.8 |
| 4,469,324 | A * | 9/1984 | Dolan | 482/7 |
| 5,238,200 | A * | 8/1993 | Ritzenthaler | 242/390.1 |
| 5,415,106 | A * | 5/1995 | Groskreutz et al. | 104/173.2 |
| 5,474,278 | A * | 12/1995 | Cleveland | 254/334 |
| 6,474,588 | B2 * | 11/2002 | Valverde | 242/390.2 |
| 6,575,112 | B2 * | 6/2003 | Roeseler et al. | 114/253 |
| 6,910,437 | B2 * | 6/2005 | O'Reilly et al. | 114/253 |
| 7,197,998 | B1 * | 4/2007 | Rice | 114/254 |
| 7,543,798 | B2 * | 6/2009 | Cunningham | 254/266 |
| 7,665,411 | B2 * | 2/2010 | Welch | 114/253 |
| 8,651,461 | B2 * | 2/2014 | Christensen et al. | 254/269 |
| 2001/0045182 | A1 * | 11/2001 | Roeseler et al. | 114/253 |
| 2002/0005451 | A1 * | 1/2002 | Valverde | 242/390.2 |
| 2003/0010272 | A1 * | 1/2003 | Sheikholeslam et al. | 114/254 |
| 2003/0047107 | A1 * | 3/2003 | Thomas | 104/173.2 |
| 2003/0084833 | A1 * | 5/2003 | Sheikholeslam et al. | 114/254 |
| 2006/0027155 | A1 * | 2/2006 | Welch | 114/254 |
| 2007/0089663 | A1 * | 4/2007 | Dunbar et al. | 116/173 |
| 2010/0114381 | A1 * | 5/2010 | Welch et al. | 700/275 |
| 2010/0121493 | A1 * | 5/2010 | Christensen et al. | 700/275 |

(Continued)

*Primary Examiner* — Zachary Kuhfuss
(74) *Attorney, Agent, or Firm* — Thomas C. Saitta

(57) ABSTRACT

A tow winch powered by a DC motor and a rechargeable battery. A tow rope is wound by the winch spool, the tow rope having a tow handle with one or more wireless throttle control members to start, stop and adjust the speed and acceleration of the retrieval operation. A marker device is incorporated into or attached to the tow rope and a sensor switch is provided on the base, whereby when the marker device is detected by the sensor switch the winch is disengaged. The base and operational components are sized and structured such that straps may be connected to the base and the tow winch carried like a backpack.

8 Claims, 3 Drawing Sheets

(56) References Cited

U.S. PATENT DOCUMENTS

| | | | | |
|---|---|---|---|---|
| 2010/0211239 | A1* | 8/2010 | Christensen et al. | 701/21 |
| 2010/0224117 | A1* | 9/2010 | Christensen et al. | 114/253 |
| 2010/0224843 | A1* | 9/2010 | Christensen et al. | 254/271 |
| 2012/0279433 | A1* | 11/2012 | Christensen et al. | 114/253 |

* cited by examiner

DC MOTOR TOW WINCH

This application claims the benefit of U.S. Provisional Patent Application Ser. No. 61/647,357, filed May 15, 2012.

BACKGROUND OF THE INVENTION

This invention relates generally to the field of powered winches, and more particularly to the field of powered winches known as tow or sport winches, whereby the winch is used to rapidly wind up a tow rope being held by a water skier, snow skier, snowboarder, surfer, wake boarder or the like.

The use of powered winches to accelerate and pull a water skier, snow skier, snowboarder, surfer, wake boarder or the like for a distance of several hundred feet is known. The winches are typically relatively large and are either fuel or AC electrically powered. The winches, if not designed for permanent installation, must be transported to a remote location using heavy equipment, trucks or similar devices.

It is an object of this invention to provide an improved tow winch, the winch being operated by a DC motor powered by a rechargeable battery, with the winch preferably being small enough to be carried by an individual. It is a further object of this invention to provide such a winch having a wireless throttle control mounted on or incorporated into the tow rope handle, such that the user controls acceleration and speed. It is a further object of this invention to provide such a winch having a wireless kill switch, such that upon operation of the kill switch or release of the tow handle by the user, the winching operation will cease. It is a further object to provide such a winch having a sensor switch and a marker device attached to or incorporated into the tow rope a short distance from tow handle such that if the marker device is sensed by the sensor switch, indicating that the majority of the tow rope has retrieved, the winching operation will cease to prevent injury to the user. It is a further object to provide such a winch in the form of a backpack.

SUMMARY OF THE INVENTION

The invention is in general a sport or tow winch powered by a DC motor and a rechargeable battery, the DC motor driving rotating a winch reel or spool directly or driving a belt or chain that turns a winch spool when a magnetic clutch is engaged. A tow rope is wound by the winch spool, the tow rope having a tow handle with a wireless throttle control to start, stop and adjust the speed of winding. A wireless kill switch may also be incorporated into the tow handle. A suitable transmitter and receiver combination is utilized to control the motor. A marker device is incorporated into or attached to the tow rope and a sensor switch is provided on the base, whereby when the marker device is detected by the sensor switch the winch is disengaged to halt the retrieval operation. The base and operational components are preferably sized and structured such that straps may be connected to the base and the tow winch carried like a backpack.

DETAILED DESCRIPTION OF THE INVENTION

With reference to the drawings, the invention will now be described in detail as to preferred embodiments and the best mode. In general, the invention is a powered tow winch having wireless controls incorporated into or mounted onto the handle of a tow rope, whereby the user can start retrieval of the tow rope onto the winch, control the speed and acceleration of the tow rope, and stop the retrieval operation as desired.

Figure 1:
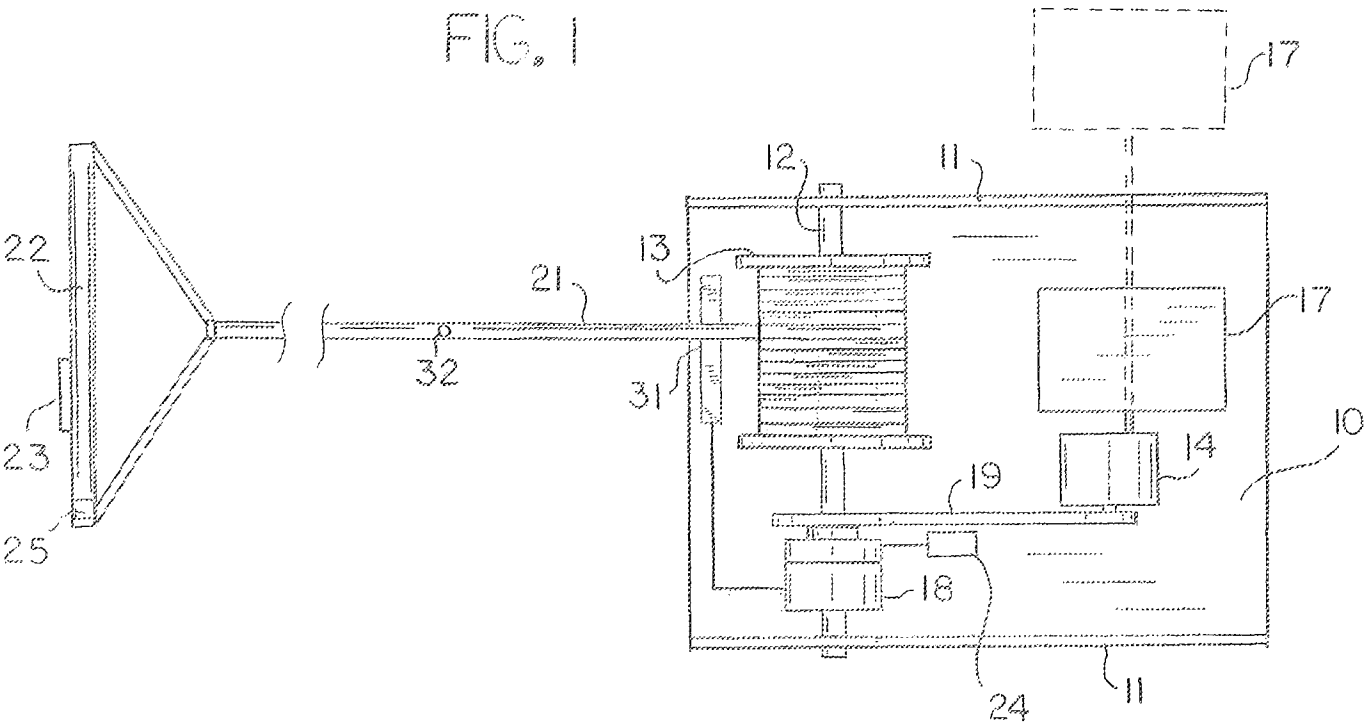
FIG. 1 is a top view of an embodiment of the powered tow winch utilizing a clutch mechanism.
Figure 2:
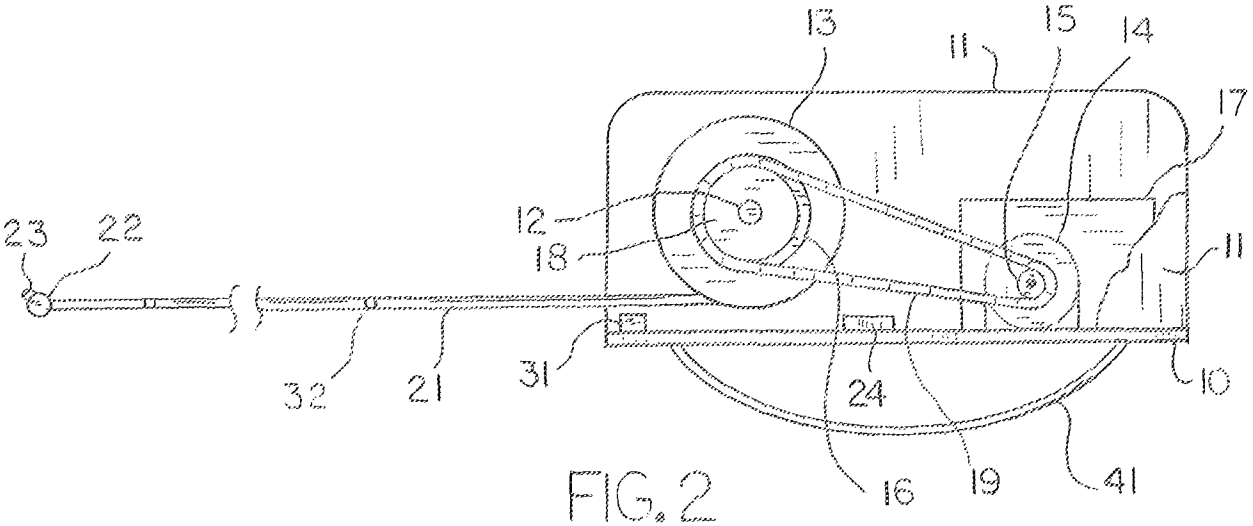
FIG. 2 is a side view of the embodiment of FIG. 1, a portion of one wall having been removed to expose interior components.

A first embodiment of the tow winch is illustrated in FIGS. 1 and 2, and as shown the tow winch comprises a base 10 with two opposing mounts or walls 11. An axle 12 extends between the walls 11 and is retained in bearings in known manner. A winch spool 13 is mounted on the axle 12 such that rotation of the axle 12 also rotates the spool 13. The spool 13 is sized to be able to retain several hundred feet of tow rope 21, preferably about 500 to 600 feet. A magnetic clutch 18 is connected to the axle 12, such that when the clutch 18 is engaged the axle 12 can be turned. The magnetic clutch 18 is connected in disengageable manner to an axle sprocket or pulley 16 that receives a chain or belt 19, the axle sprocket or pulley 16 being free to rotate independently of the axle 12 when the magnetic clutch 18 is disengaged. The chain or belt 19 is also mounted onto a drive sprocket or pulley 15 that is driven by a DC motor 14. A rechargeable battery 17, such as for example a lithium ion battery, is provided to power the DC motor 14. The battery 17 is preferably removable for easier recharging.

The tow rope 21 is provided with a tow handle 22, and a throttle control member 23 is mounted onto or incorporated in the tow handle 22. The throttle control member 23 may be for example a thumb switch, a pressure switch or any other suitable mechanism for transmitting control commands. The throttle control member 23 is wireless and transmits a signal, such as a radio frequency signal for example, to a wireless receiver 24 that operates the magnetic clutch 18 and/or the DC motor 14. In one embodiment, the DC motor 14 may be arranged to drive the chain or belt 19 and the axle sprocket or pulley 16 continuously, but with rotation of the axle 12 and spool 13 occurring only if the magnetic clutch 18 is engaged by the user.

As a safety feature, a marker member 32, such as a magnet or metal member, is attached to or incorporated into the tow rope 21 a relatively short distance, e.g., about 35 feet, from the tow handle 22. A sensor switch 31 is mounted on the base 10 adjacent the spool 13 such that if the marker device 32 is detected by the sensor switch 31 during the winding of the tow rope 21 the magnetic clutch 18 is automatically disengaged, thereby stopping the retrieval action of the winch spool 13 to insure that the user is not pulled into the tow winch or pulled too close to shore in water applications.

When the tow winch is in neutral, the DC motor 14 will rotate the axle sprocket or pulley 16 but the disengaged magnetic clutch 18 will not deliver this rotation to the axle 12. The winch spool 13 is free-spinning in this status, such that the tow rope 21 can be unwound from the winch spool 13. When the tow rope 21 is played out, the user initiates the towing action through the throttle control switch 23, thereby engaging the magnetic clutch 18 such that the winch spool 13 is rotated by the DC motor 14 and the tow rope 21 is retrieved, thus pulling the user forward. Preferably the throttle control member 23 allows the user to control the acceleration or deceleration and to increase or decrease the winding speed, either over a continuous spectrum or in incremental stages. If the user wishes to stop the winding action, the throttle control member 23 is used to disengage the magnetic clutch 18.

Figure 3:
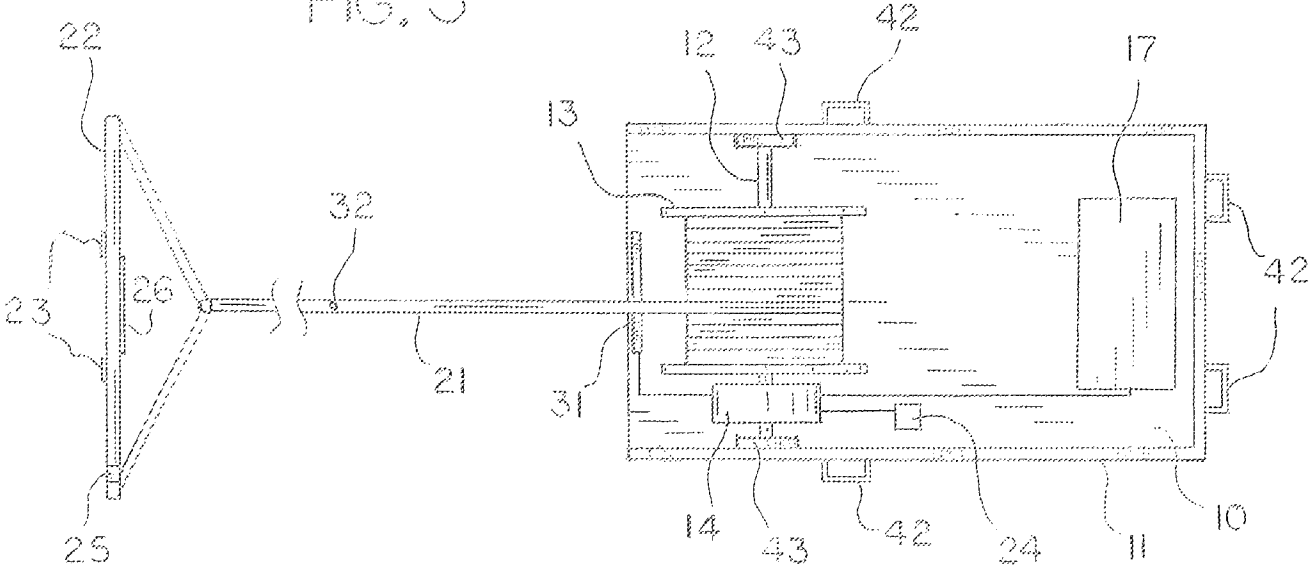
FIG. 3 is a top view of an alternative embodiment of the powered tow winch wherein the motor is directly connected to the winch spool.

Alternatively, as shown in FIG. 3, a wireless grip or kill switch 26 is incorporated into or on the tow handle 22, the kill switch 26 being in communication with the transmitter 25 such that engagement of the kill switch 26 causes the transmitter 25 to deliver a signal to the receiver 24 that allows the motor 14 to operate, while disengagement of the kill switch 26 results in deactivation of the motor 14. The kill switch 26 may be, for example, a pressure or contact type switch. The kill switch 26 is preferably centrally disposed on the tow handle 22, such that if a user is holding the tow handle 22 with only one hand, that hand will be able to contact and engage the kill switch 26. In the event that the user no longer contacts or engages the kill switch 26 or completely releases the handle 22, the retrieval action of the tow winch is halted.

Also as shown in FIG. 3, an alternative embodiment of the tow winch comprises a DC motor 14 directly connected to the axle 12 and spool 13. As before, operation of the motor 14 and therefore control of the retrieval action of the tow winch is controlled by the throttle control members 23. In this embodiment, two throttle control members 23 are separately disposed on the tow handle 22. The separate throttle control members 23 may independently control the retrieval operation, with each function duplicated on each throttle control member 23. Alternatively, the throttle control members 23 may control different functions. For example, one may be used to accelerate and the other used to decelerate.

The base 10 is preferably structured such that it may be worn as a backpack by the user, strap members 41 being attached to the underside of the base 10 or to handles 42. The components necessary to wind 500 to 600 feet of rope at about 35 mph are small enough in size and weight such that transport by a single user is possible, particularly if the battery 17 is removed and carried separately. This enables the user to take the tow winch to remote locations inaccessible by powered vehicles. Preferably a cover member (not shown) is provided over the base member 10.

I claim:

1. A tow winch comprising:

a winch spool;

a tow rope wound upon said winch spool, said tow rope comprising a tow handle;

a DC motor rotating said winch spool;

a rechargeable battery operating said motor;

one or more throttle control members mounted on or in said tow handle;

a wireless transmitter mounted on or in said tow handle in communication with said one or more throttle control members;

a wireless receiver in communication with said transmitter;

whereby operation of said one or more throttle control members causes said transmitter to send a signal to said receiver to control rotation of said winch spool; and further comprising a marker member attached to said tow rope and a sensor switch, wherein said marker member comprises a magnet, whereby said sensor switch halts rotation of said winch spool upon sensing said marker member.

2. The tow winch of claim 1, further comprising an axle, wherein said winch spool is mounted onto said axle and said motor rotates said axle to rotate said winch spool.

3. The tow winch of claim 1, wherein operation of said one or more throttle control members controls said motor.

4. The tow winch of claim 1, further comprising an axle and a clutch connected to said axle, wherein said winch spool is mounted onto said axle and said motor rotates said clutch to rotate said axle to rotate said winch spool, and whereby operation of said one or more throttle control members causes said transmitter to send a signal to said receiver to engage or disengage said clutch from said axle to control rotation of said winch spool.

5. The tow winch of claim 1, wherein said battery is removable from said tow winch for recharging.

6. The tow winch of claim 1, further comprising a base, walls and handles mounted to said walls.

7. The tow winch of claim 1, further comprising a base, walls and straps mounted to said base or walls, whereby said tow winch may be worn as a backpack.

8. The tow winch of claim 1, further comprising a wireless kill switch mounted in or on said tow handle and in communication with said transmitter, whereby engagement of said kill switch allows rotation of said winch spool, while disengagement of said kill switch precludes rotation of said winch spool.

* * * * *